US011525313B2

(12) United States Patent
More et al.

(10) Patent No.: US 11,525,313 B2
(45) Date of Patent: Dec. 13, 2022

(54) WEAR ENHANCEMENT OF HDD DRILL STRING COMPONENTS

(71) Applicants: Mark More, West Bend, WI (US); Casey Placek, Van Dyne, WI (US); Tina Giese, Brownsville, WI (US); James Wessing, Kewaskum, WI (US)

(72) Inventors: Mark More, West Bend, WI (US); Casey Placek, Van Dyne, WI (US); Tina Giese, Brownsville, WI (US); James Wessing, Kewaskum, WI (US)

(73) Assignee: Kondex Corporation, Lomira, WI (US)

( * ) Notice: Subject to any disclaimer, the term of this patent is extended or adjusted under 35 U.S.C. 154(b) by 16 days.

(21) Appl. No.: 16/951,356

(22) Filed: Nov. 18, 2020

(65) Prior Publication Data

US 2021/0156206 A1 May 27, 2021

Related U.S. Application Data

(60) Provisional application No. 62/940,086, filed on Nov. 25, 2019.

(51) Int. Cl.

| | |
|---|---|
| ***E21B 17/10*** | (2006.01) |
| ***E21B 7/04*** | (2006.01) |
| ***E21B 17/04*** | (2006.01) |

(52) U.S. Cl.

CPC ..... *E21B 17/1085* (2013.01); *E21B 7/046* (2013.01); *E21B 17/04* (2013.01)

(58) Field of Classification Search

CPC ..... E21B 17/1085; E21B 7/046; E21B 17/04; E21B 17/10

See application file for complete search history.

(56) References Cited

U.S. PATENT DOCUMENTS

| | | | |
|---|---|---|---|
| 3,871,836 | A | 3/1975 | Polk et al. |
| RE29,898 | E | 5/1979 | Polk et al. |
| 6,039,127 | A | 3/2000 | Myers |
| 6,375,895 | B1 | 4/2002 | Daemen |
| 6,390,087 | B1 | 5/2002 | Wentworth et al. |
| 6,450,269 | B1 | 9/2002 | Wentworth et al. |

(Continued)

FOREIGN PATENT DOCUMENTS

| | | | |
|---|---|---|---|
| AU | 2001288875 | B2 | 3/2016 |
| JP | 5975697 | B2 | 8/2016 |

(Continued)

OTHER PUBLICATIONS

U.S. Appl. No. 16/836,175, filed Mar. 31, 2020, Johnson et al.
U.S. Appl. No. 62/833,283, filed Apr. 12, 2019, Johnson et al.
U.S. Appl. No. 62/566,796, filed Oct. 2, 2017, Johnson et al.

*Primary Examiner* — Taras P Bemko
(74) *Attorney, Agent, or Firm* — Reinhart Boerner Van Deuren P.C.

(57) ABSTRACT

A hard facing is preferably accomplished with laser clad beads applied to horizontal directional drilling (HDD) component(s). These components may be subject to recirculating fluid regions associated to stepped geometries along a drill string, including various drill string coupling members. For example, laser cladding can be applied to a step region of the sonar housing and starter rod. A method applies a hard face coating such as laser cladding or other suitable hard facing in areas of tight geometric tolerances.

40 Claims, 7 Drawing Sheets

(56) References Cited

U.S. PATENT DOCUMENTS

| | | | | |
|---|---|---|---|---|
| 6,588,515 | B2 | 7/2003 | Wentworth et al. | |
| 6,887,586 | B2 | 5/2005 | Pecker et al. | |
| 2001/0017222 | A1* | 8/2001 | Wentworth | E21B 7/064 175/19 |
| 2003/0024741 | A1 | 2/2003 | Wentworth et al. | |
| 2005/0011643 | A1 | 1/2005 | Slack et al. | |
| 2006/0021800 | A1 | 2/2006 | Beuerschausen et al. | |
| 2007/0261867 | A1* | 11/2007 | Techel | A01F 29/09 172/811 |
| 2010/0065337 | A1 | 3/2010 | Luce et al. | |
| 2010/0101780 | A1 | 4/2010 | Ballew et al. | |
| 2011/0318129 | A1 | 12/2011 | Piper | |
| 2013/0099553 | A1 | 4/2013 | Krauter | |
| 2015/0114199 | A1 | 4/2015 | Shepard et al. | |
| 2015/0258628 | A1 | 9/2015 | Flak et al. | |
| 2016/0157423 | A1 | 6/2016 | Stoffel et al. | |
| 2016/0340985 | A1 | 11/2016 | Didry | |
| 2017/0321487 | A1* | 11/2017 | Gunsaulis | E21B 10/30 |
| 2019/0345615 | A1* | 11/2019 | Dworak | B64F 5/10 |
| 2020/0109465 | A1* | 4/2020 | Cao | C22C 38/04 |
| 2020/0224499 | A1 | 7/2020 | Johnson et al. | |
| 2020/0325584 | A1 | 10/2020 | Johnson et al. | |
| 2021/0148177 | A1* | 5/2021 | Slaughter, Jr. | E21B 17/16 |

FOREIGN PATENT DOCUMENTS

| | | | |
|---|---|---|---|
| WO | WO 2019/0070639 | A1 | 4/2019 |
| WO | WO 2020/210063 | A1 | 10/2020 |

* cited by examiner

WEAR ENHANCEMENT OF HDD DRILL STRING COMPONENTS

CROSS-REFERENCE TO RELATED PATENT APPLICATIONS

This patent application claims the benefit of U.S. Provisional Patent Application No. 62/940,086, filed Nov. 25, 2019, the entire teachings and disclosure of which are incorporated herein by reference thereto.

FIELD OF THE INVENTION

The present invention relates to horizontal directional drilling (HDD) components (e.g. boring bits, collars, housings, reamers, pipe) for cutting and boring applications, and more particularly may relate to reducing wear characteristics of stepped geometries on said components.

BACKGROUND OF THE INVENTION

Horizontal directional drilling (HDD) is a heavily growing segment of the construction industry. In the past, antiquated equipment such as excavators and trenchers were used to place cables, wires and conduits. With environmental and efficiency concerns, the HDD industry has evolved and through new technology is displacing much of the conventional equipment. Utilizing HDD, the same infrastructure can be placed faster, more economically, and with less environmental impact.

Horizontal directional drilling is achieved by first starting an angled bore hole into the earth. Several components work in tandem to move and excavate the hole, with the main tool at the end of the drill string known as a boring bit. The bit prescribed for the job is dependent upon the main equipment capability, substrate media and infrastructure type. The bit is paramount to the efficiency of the bore, as the bit is primarily responsible for the cutting and steering. To aid in the cutting efficiency of the bit, a slurry mixture of water and clay (bentonite) is pumped through the drill string and ejected through nozzles at the cutting interface. The slurry serves several purposes, including help create a smooth borehole wall, cool the drill string, lubricate the drill string, hydro excavate loose substrate, and carry cuttings back out of the borehole. With this method, the bit is steered to a desired depth and around any obstructions encountered along the bore with the use of sonar tracking equipment. Sonar tracking is required for locational accuracy above ground from the beginning of the bore to the end. The bit is then steered back towards the surface where it exits the ground creating the first "pilot" hole. If the pilot hole is large enough for the infrastructure, it can be pulled back through the hole immediately, otherwise reaming bits would be pulled back through the hole to enlarge it to appropriate infrastructure diameter. When pulling back it is suggested to remove the sonar housing and boring bit and attaching the appropriate pull back mechanism. In the interest of time and efficiency, the dis-assembly and pull back mechanism are not often utilized, and the boring bit and sonar housing are left on when pulling back through the hole.

To join HDD components together, various different coupling systems are used. One of the most common systems utilized in the industry is a threaded member (e.g. a tube and/or shaft) and locking collar to securely transfer axial push/pull force and rotational torque from the drill string to the drill bit. It is noted that other mechanical coupling systems exist in the industry, IE Roll pin connections and tight tolerance machining features, to which this invention may also be realized upon.

Generally when attaching the collar to the sonar housing, the collar will have an outer diameter the same size as the sonar housing, but a larger diameter when compared to the starter rod. This difference in diameter is due to mechanical limitations of the coupling system, and to reduce disruption in the bore hole. If the starter rod and sonar housing diameters were matched, the collar would have to exceed the diameter of the sonar housing, creating a stepped profile in the direction of drilling motion hindering the operation, undesirably creating a small stepped reamer.

The sonar housing is equipped to receive the boring bit or sub adapter on one end via spline or threads, and the starter rod on the other via locking collar. The collar splined region may have any geometry on the inner surface, so long as it matches that of the starter rod and sonar housing. Currently a polygonal inner spline is the most common geometry used in either a hex or octagon form. To couple the two members together, the collar is slid onto the starter rod, which is attached to the main drill string prior to attaching the sonar housing and drill bit. With the collar on the starter rod, the sonar housing is threaded onto the starter rod. When the sonar housing is screwed on completely the unit is rotated counter clockwise until the starter rod outer coupling geometry meets up with the sonar housing coupling geometry. When the two components are lined up the collar is slid back over the starter rod and across the joint between sonar and starter rod. A pin is then tightly fit into the collar through the sonar housing thus locking the three pieces together.

The final assembly then comprises a drill bit, sonar housing adapter, sonar housing, collar, and starter rod. This configuration has no stepped upped geometries when looking back from the direction of travel. As stated above this helps minimize disruption in the bore hole and maintain a smooth wall.

With advancements in the industry and processing capabilities, many different hard face methods can be applied to the drill string components. Several attempts have been made to create wear plates that are fastened to the components. These attempts have shown to be an effective method of wear mitigation, but with limitations due to the process (primarily weld hard facing). In some cases, the additional hard facing may also create the un-desired step geometry. Due to the assembly method required for the drill string, conventional weld hard facing methods are difficult to apply and not the most beneficial solution. Weld hard facing may also create undesirable softer heat affected zone regions in the base material that may be subject to increased erosion.

Accordingly, various improvements over the state of the art are presented herein.

BRIEF SUMMARY OF THE INVENTION

It is contemplated that the primary wear related to a rear-facing stepped geometry, such as in the case above, is a re-circulation region of the cutting fluid. As the fluid is pumped out the end of the drill string, rock cuttings, sand, and other debris become suspended in the slurry. This suspension mixture is carried back out through the drill hole. As this fluid suspension travels over the rear-facing stepped geometry, it encounters a low-pressure region, creating a recirculation zone.

When this suspension re-circulates in the low-pressure region it subjects the base geometry to velocity vectors perpendicular to the main direction of fluid flow. This flow, containing rock cuttings, sand and other debris, repeatedly being directed at the base material in the re-circulation zone will present rapid wear characteristics.

Ideally, the fluid evacuates the bore hole at an even flow rate radially around the drill string. Rocks and obstructions down hole can impede this even flow, directing some of the fluid to different paths creating localized regions of high and low pressures. If the fluid flow rate is high enough, and the bore hole geometry allows, the drill fluid flowing over the very low pressure stepped region could cause cavitation.

According to an inventive aspect, a horizontal directional drilling (HDD) component is provided for use in a drill string comprises two or more mechanically fastened members that provide a diametrically reduced stepped geometry along a direction of drilling. The horizontal directional drilling (HDD) component comprises a drill string component including selective hard facing arranged to reduce accelerated wear proximate a region of the diametrically reduced stepped geometry.

According to an inventive aspect a horizontal directional drilling (HDD) component is provided for use in a drill string, which comprises: a drill string component including selective hard facing. The hard facing comprises a laser clad bead deposited upon a steel material substrate of the drill string component. According to this aspect, the drill string component is other than a drill bit and comprises at least one of an HDD starter rod, an HDD coupling collar, an HDD sonar housing, an HDD drill bit adapter, an HDD drill pipe, and an HDD drill reamer.

In view of the foregoing, various other inventive aspects and features are contemplated that may be used in conjunction, addition and/or separately.

Some aspects of the present invention relate to hard facing a horizontal directional drilling (HDD) component(s), that are/is subject to recirculating fluid regions associated to stepped geometries along the drill string. It has been recognized that weld hard facing can be used as a wear solution, but geometric physical limitations arise when applying it to drill string coupling members such as the sonar housing and starter rod.

An aspect according to an embodiment of the invention is directed toward a method for applying a hard face coating in areas of tight geometric tolerances. This method comprises hard facing the horizontal directional drilling (HDD) component at a region of fluid re-circulation imparted by a geometric feature (e.g. a step (or cutout that also creates a step)).

The method to create the hard facing may comprise: melting the base material with a laser to form a melt pool; depositing a stream of particles of the clad material into the melt pool; and solidifying the melt pool to affix the particles of the clad material.

The hard facing in some embodiments may create a heat affected zone, which can compromise the structural integrity of the base material. Therefore, preferably, the hard facing comprises a laser clad hard face coating, but can also involve a plasma transferred arc (PTA) hardfacing, a weld hard faced coating, and or a mechanically bonded coating. All of these options may feature a coating hardness that is preferably greater than 50 HRC.

One preferred way to make the hard face coating for laser deposition comprises a coating composition primarily of nickel and tungsten.

Another feature that may be used is that the hard face layer is formed from a bead of laser cladding, comprising at least one of the following materials: tungsten carbide, titanium carbide, iron carbide, diamond, ceramic, and other material having a Vickers scale hardness between HV 1000-3500.

Various advantages may be realized. For example, the hard face coating may be used on selective regions to re-direct the flow of fluid towards regions of higher pressures.

Different parts and/or combinations of parts may be hard faced in different embodiments.

For example, in different embodiments the hard faced horizontal directional drilling (HDD) component may be one or more of the following: the HDD coupling collar, the HDD sonar housing, the HDD drill bit adapter, the HDD drill, an HDD drill pipe, and/or an HDD drill reamer.

Various other parameters and features may also be employed.

For example, preferred and/or typical part sizes may be as follows: the starter rod outer diameter may be between 1 and 6 inches; and/or the collar outer diameter may be between 1 and 8 and inches.

Preferably, the diametrically stepped geometry such as in region of the step region 16 may have a hard facing applied along at least the smaller circumferential region (e.g. along a recirculation zone shown in FIG. 5) and also preferably to an outer circumferential region. To the inner circumferential region, hard facing may be applied to a minimum axially extending length of 5% and a maximum axial extending length of 50% of the outer circumference of the components being joined. For example, what is meant by this is that if the drill string has a diameter of 2 inches (e.g. outer diameter of the step), the axially extending length of selective hard facing applied at the recirculation zone of the step region along the drill string would be considered 0.31" or 5% up to 3.14" or 50%.

Preferably the diametrically stepped geometry has a radial extent that is a minimum of 5% and to a maximum of just under 100% (e.g. 99%) relative to the components being joined, or the component used to join them together. For example, what is meant by this is that if the drill string has a diameter of 2 inches (e.g. outer diameter of the step), and the step has a dimension of 0.1 inch, that would be 5%; and if the step is approaching 2 inch that would be approaching 100%.

Preferably, the hard face coating has a coating hardness greater than 50 HRC.

Preferably, the hard face coating comprises a matrix primarily of nickel and tungsten carbide.

Preferably, the hard face comprises a mechanically bonded coating.

In some embodiments, the hard face coating may be placed on the reverse thrust face of the stepped geometry. In other embodiments, the hard face coating is placed additionally and/or alternatively on the outer diameter immediately up-string and/or down-string from the stepped geometry.

Preferably, the Heat Affected Zone (HAZ) created by hard facing does not extend beyond 0.080" of the base material surface after coating.

In some embodiments, an adjacent drill string component is secured to said drill string component to provide the diametrically reduced stepped geometry.

In such an embodiment, the adjacent drill string component may include a flange region that can overlap the selective hard facing of said drill string component to allow for assembly.

In such an embodiment, the adjacent drill string component may also or alternatively include a hard face region spaced from the selective hard facing of the of said drill string component and proximate the region of the diametrically reduced stepped geometry.

Another aspect is directed toward a directional drilling (HDD) component assembly comprising: a first drill string component; a second adjacent drill string component secured to the first drill string component; a step defined between the first drill string component and the second adjacent drill string component; and hard facing applied to a region of at least one of the first drill string components and the second adjacent drill string component, the region being proximate the step.

Preferably, the hard facing is applied within 0 to 30 centimeters of the step and more preferably within 0 to 15 centimeters of the step.

The step may be formed by a radially extending surface extending radially outward away from a first annular surface of the first drill string component toward a second annular surface of the second adjacent drill string component. The hard facing may be applied along at least a portion of at least one of the radially extending surfaces, the first annular surface and the second annular surface.

More preferably, the hard facing is applied along at least portions of at least two of the radially extending surfaces, the first annular surface and the second annular surface.

Most preferably, the hard facing is applied along at least portions of all three of the radially extending surfaces, the first annular surface and the second annular surface.

It is advantageous if the hard facing is selective. For example, the hard facing may be applied to less than 50% of an exposed external surface area of the first drill string component and the second adjacent drill string component, and even more preferably less than 20% of the exposed external surface area.

Typically, the first drill string component and the second adjacent drill string component comprise a base material comprising an iron or steel material.

Further, the hard facing may comprise a laser clad bead applied to the iron or steel material, and preferably the laser clad bead provides a height extending from a surface of the steel material substrate of between 0.01 and 0.25 inch.

In an embodiment, the second adjacent drill string component comprises a collar slidable over the first drill string component, with the hard facing being applied to a reverse thrust face of the collar and an outer circumference of the collar, and applied along the first drill string component adjacent the reverse thrust face.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
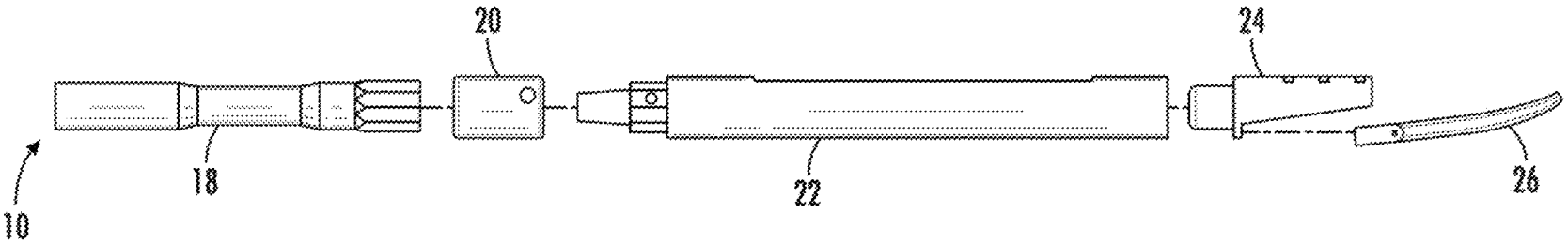
FIG. 1 is an exploded schematic side view of the cutting end of the drill string. This figure shows the separate components to the drill string starting from left to right, including but not limited to the starter rod, coupling collar, sonar housing, bit adapter, and boring bit.
Figure 2:
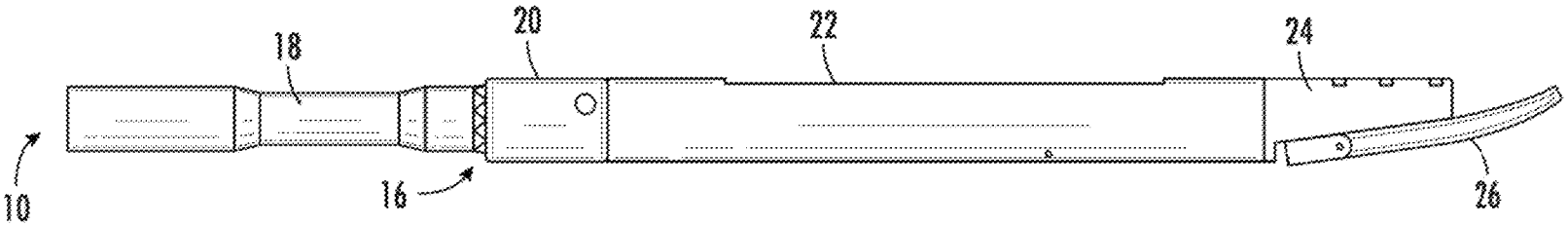
FIG. 2 is an assembled schematic side view of the cutting end of the drill string. This figure shows how the components fit together and the resulting geometry of the final drill string members.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The present application relates to improving the wear characteristics of any HDD drill string component or joint that experiences rapid wear.

In particular, in an embodiment, any of the HDD drill string components illustrated or described above may be subjected to the hard face coating wear improvement.

In greater detail and turning to the Figures, an embodiment of the present invention in FIGS. 1-10 is illustrated as a drill string assembly 10 (aka "drill string"). In FIGS. 1 and 2, and 4-6, the drill string assembly components are illustrated without the hard facing applied (e.g. prior to hard facing application), whereas in FIGS. 3, 7-10, one or more hard facing regions 12, 14 are applied.

For example, the hard face regions 12, 14 can be applied to create selective hard facing that is arranged to reduce accelerated wear proximate a region of the diametrically reduced stepped geometry provided by a step region 16.

In the illustrated embodiment, the drill string assembly comprises: a starter rod 18, a starter rod collar 20, a sonar housing 22, optionally a housing or bit adapter 24, and removable boring bit 26. Each of these components may be referred to individually as a horizontal directional drilling (HDD) component" and/or a "drill string component, or similar. However, other assemblies with more or less components are intended to be covered, and in some embodiments a single horizontal directional drilling (HDD) component may be covered.

As apparent from the figures, each horizontal directional drilling (HDD) component is for use in a drill string comprising two or more mechanically fastened members that can provide a diametrically reduced stepped geometry along a direction of drilling such as provided by the step 16, which in this case is between the collar 20 and the starter rod 18.

Fastening may be accomplished between adjacent horizontal directional drilling (HDD) components as illustrated via steps schematically shown in FIGS. 3A-3D, such as using threaded attachment, spline attachments, pins, and/or other such couplers. For example, the sonar housing 22 can be equipped to receive the boring bit 26 such as via an optional sub adapter 24 on one end via spline and/or threads. The sonar housing 22 can be coupled to the starter rod 18 on the other via the locking collar 20. The collar 20 can have a splined region may have any geometry on the inner surface 28, that matches that of the outer surface 30 of the starter rod 18 and the outer surface 32 of the sonar housing 22. For example, a polygonal spline for the spined surfaces 28, 20, 32 is the most common geometry used in either a hex or octagon form.

Figure 3A:
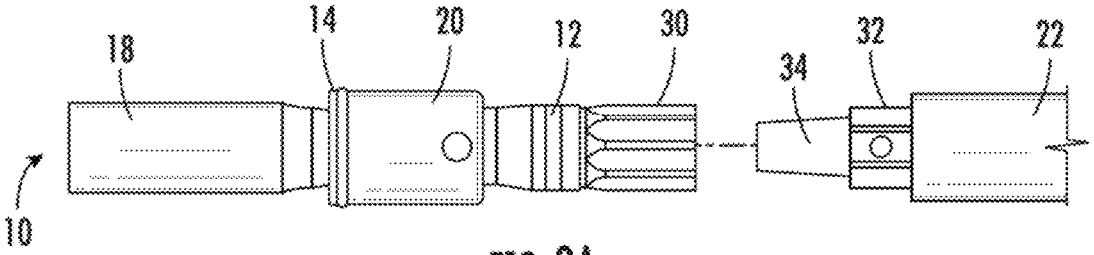
FIGS. 3A-3D are assembly schematic side views showing the required steps in sequence A-D for coupling HDD drill string components together. The primary components in this example include the starter rod, coupling collar, and sonar housing.
Figure 3B:
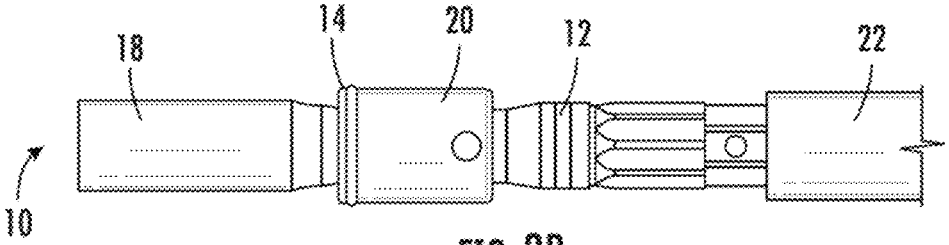
Figure 3C:
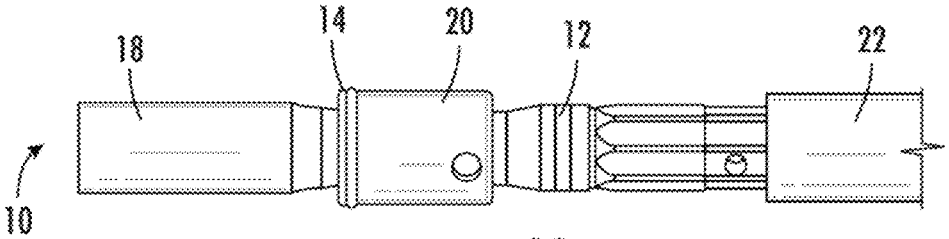
Figure 3D:
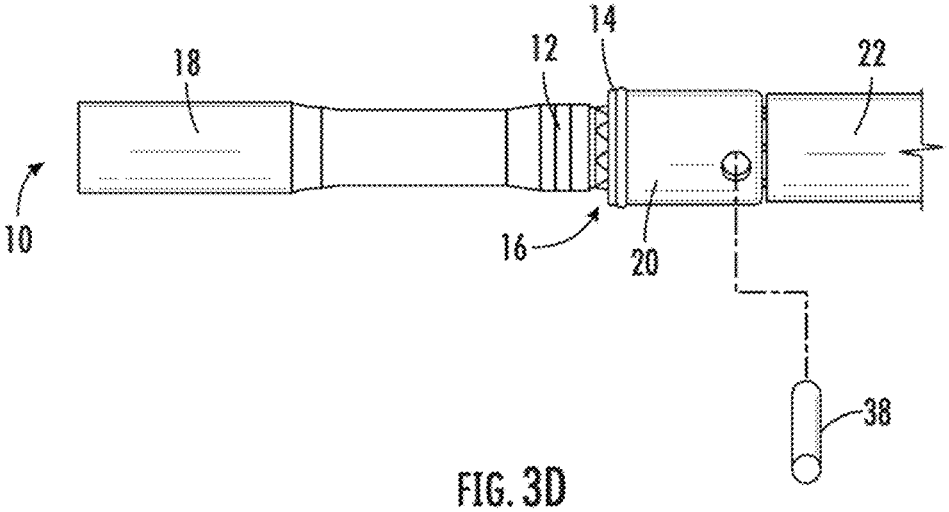

To couple the two members together in the present embodiment, the collar 20 is slid onto the starter rod 18, which may be attached to the main drill string prior to attaching the sonar housing 22 and the drill bit 26 (See FIG. 3*a*). With the collar 20 on the starter rod 18, the sonar housing 22 is threaded onto the starter rod 18 (FIG. 3*b*-3*c*), via interlocking rod thread 34 and housing thread 36, in which one may be a threaded receptacle and the other a threaded boss, respectively or vice versa. When the sonar housing 22 is screwed on completely, the unit is rotated counter clockwise until the starter rod outer coupling geometry (e.g. outer surface 30) meets up with the sonar housing coupling geometry (e.g. outer surface 32), as shown in FIG. 3*c*. When the two components are lined up the collar 20 is slid over the starter rod 18 and across the joint between the sonar housing 22 and the starter rod 18. A pin 38 or bolt can then tightly fit into the collar 20 through the sonar housing 22 thus locking the three pieces together.

As apparent, the starter rod 18 can utilize a polygonal spline on the outer surface and internal threads on the inner diameter to affectively lock it to the adjacent component.

Similarly, the collar 20 can utilize a polygonal inner spline to join two drill string components together.

Also similarly, the sonar housing 22 can utilize a polygonal outer spline on the outer surface and external threads on a boss diametrically smaller than the polygonal spline to affectively lock it to the adjacent component.

While the location at step 16 is illustrated to be hard-faced, other locations along the drill string may be hard faced in addition or in the alternative to regions 12, 14, especially but not limited to stepped regions.

For example, in different embodiments, the hard faced horizontal directional drilling (HDD) component may be one or more of the following: the HDD coupling collar 20, the HDD sonar housing 22, the HDD drill bit adapter 24, the HDD drill bit (i.e. boring bit 26), an HDD drill pipe, an HDD drill reamer.

Figure 4:
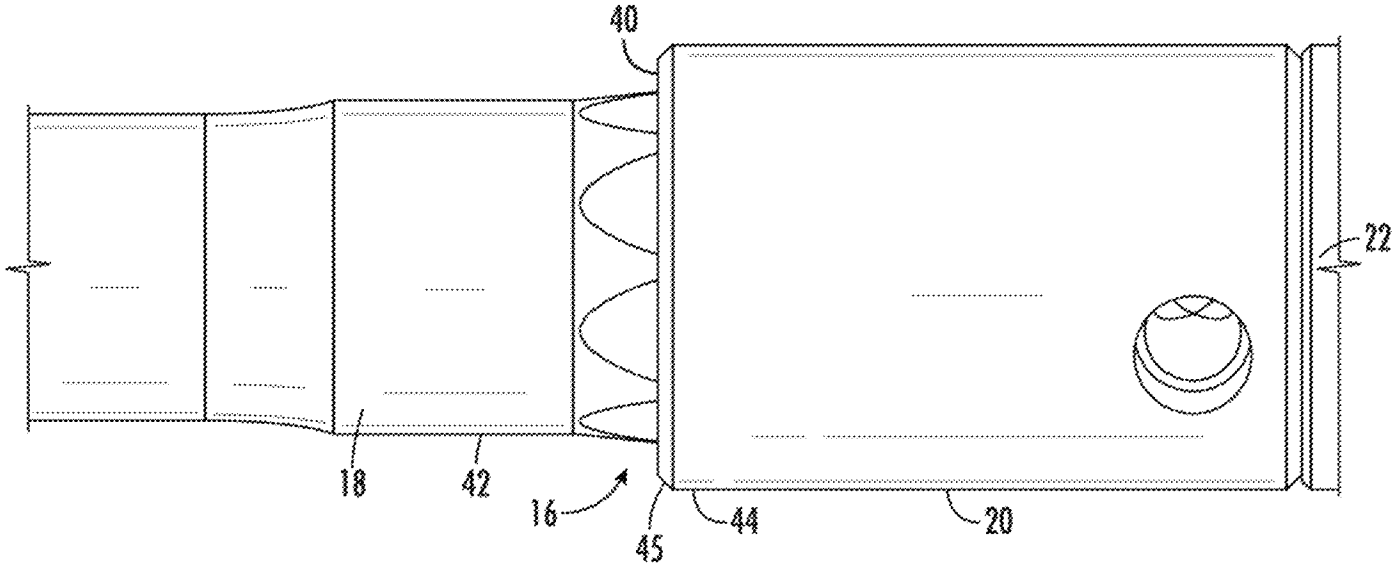
FIG. 4 is a partly schematic side view of the coupling joint provided by the collar and between the starter rod and the sonar housing described in FIGS. 1, 2 and 3, and better showing the stepped geometry created by the coupling collar over the starter rod.
Figure 5:
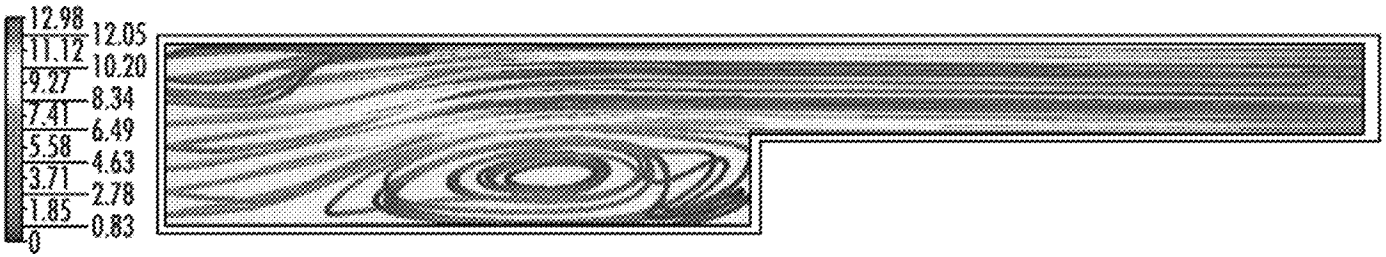
FIG. 5 is a schematic illustration of a flow contour solved over a simulated geometry representative of FIG. 4, with velocity contours of the flow showing the large recirculation zone present directly behind the collar.
Figure 6:
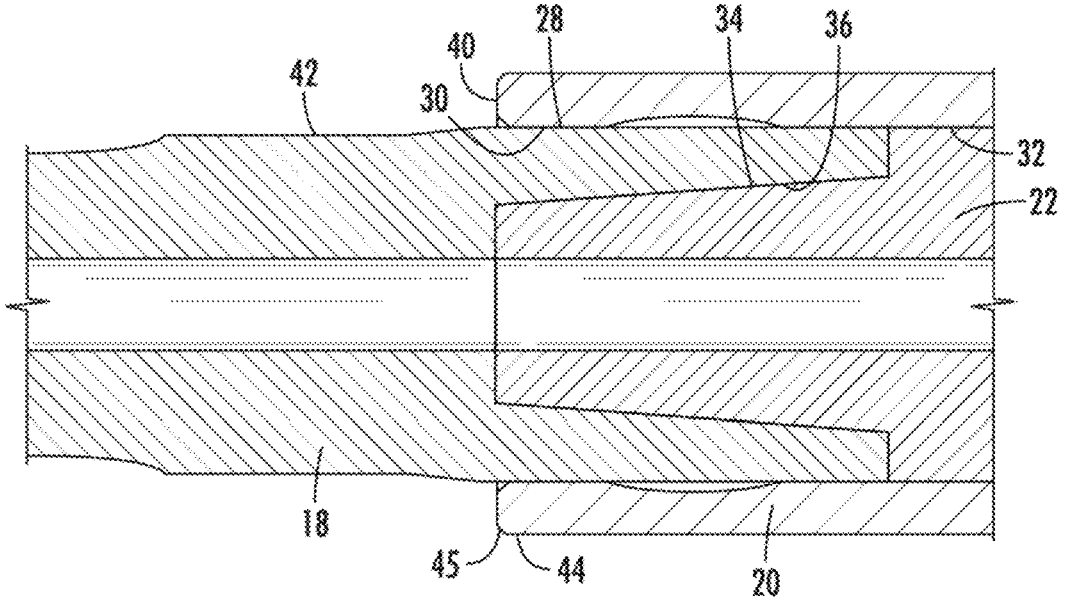
FIG. 6 is an exaggerated schematic cross section through a central axis of the starter rod showing the location of the recirculation and potential cavitation zone.
Figure 7:
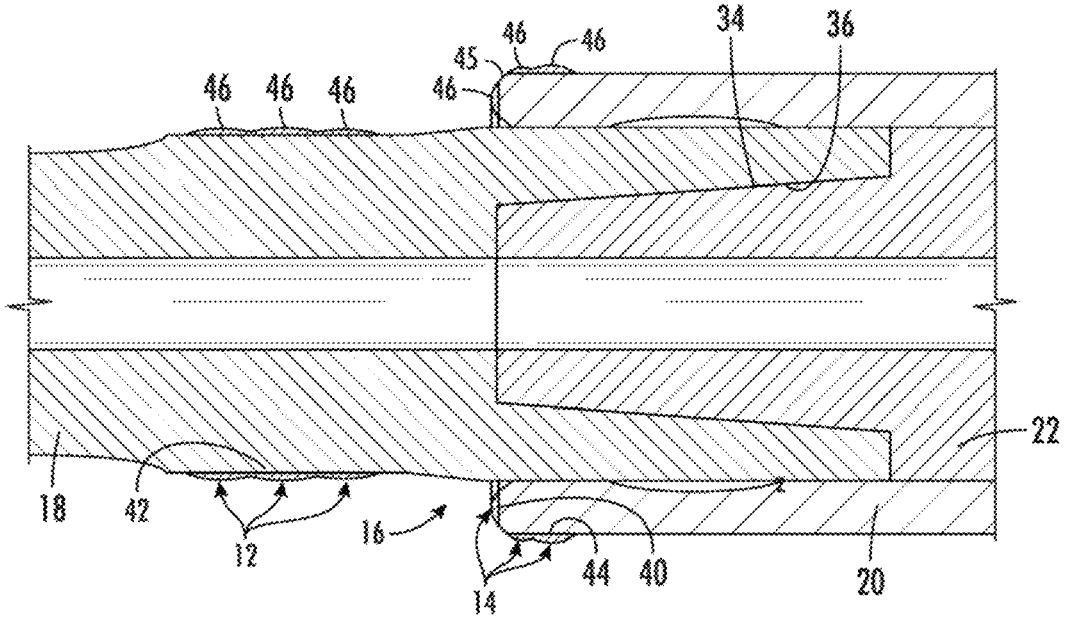
FIG. 7 is an exaggerated schematic cross section through a central axis similar to FIG. 6, but additionally and in accordance with an embodiment of the present invention depicting a single layer cladded surface of the starter rod and coupling collar. Also, of functional advantage, the hard face layer on the starter rod may not exceed the inner diameter of the coupling collar.

The selective hard facing provided by one or more of the hard face regions 12, 14 can be arranged to reduce accelerated wear proximate a region of the diametrically reduced stepped geometry. As shown in FIG. 7 (with additional reference to FIGS. 4 and 5 showing the recirculation zone created from the stepped outer surface profile), the diametrically reduced stepped geometry is provided at the step 16 which is created at a joint location when one drill string component (in this case starter rod 18) is arranged in overlapping relation with another one of the mechanically fastened members (in this case collar 20). In this manner due to the step, the drill string component has a predetermined recirculation zone region (see FIG. 5) for which the selective hard facing 12, 14 (e.g. laser clad beads 46) are applied along the predetermined recirculation zone region.

For example, the hard face coating can be placed on the reverse thrust face 40 of the stepped geometry.

As another example, the selective hard facing can placed on the outer diameter 42 immediately up-string from the stepped geometry, such as on the forward surface region of the starter rod 18.

Yet as another example, the selective hard facing can be placed at the outer circumferential surface 44 of such a step, such as at the up-string corner 45 of the sonar housing 22 (that is therefore down-string from the step).

Accordingly, in one or more and preferably all of these regions of the step, selective hard facing can counteract the increased wear that can be realized in a stepped assembly as indicated by FIG. 5.

Preferably, selective hard facing as provided by the hard face regions 12, 14 can be created by laser cladding with one or more laser clad beads 46. For example, 6 different rings of laser clad beads 46 may be used as illustrated in the figures, although fewer or more beads may be laid upon the steel material substrate.

Preferably, the laser clad beads 46 are relatively thin depositions to minimize impact to part diameters and reduce impact relative to flow or frictional engagements. For example, the laser clad bead can provide a height extending from a surface of the steel material substrate of between 0.01 and 0.25 inch.

An advantage of using a laser clad bead 46 is that the Heat Affected Zone (HAZ) 48 (shown schematically in FIG. 9) may be limited, such as not extending beyond 0.08 inch of the base material surface after coating. This advantageously can prevent soft zones that may create erosion zones in the base material. Laser cladding may also heat treat the underlying base material.

The present disclosure also contemplates that other drill string components may be subject to laser cladding other than the drill bit, for example, such HDD component may be at least one of an HDD starter rod, an HDD coupling collar, an HDD sonar housing, an HDD drill bit adapter, an HDD drill pipe, and an HDD drill reamer.

Figure 12:
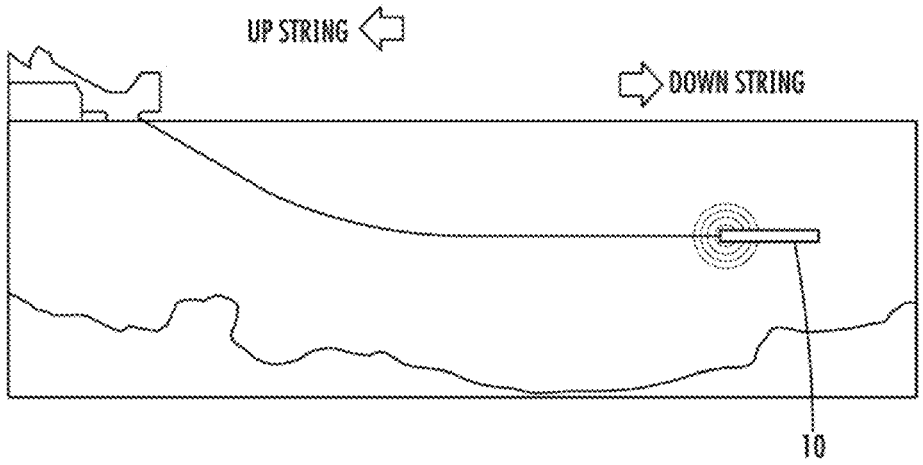
FIG. 12 is a general diagram showing a typical HDD unit and drill string. Of note are the directions of "Up string" and "Down string" used in the description herein.

As shown in FIG. 12, the drill string assembly 10 can be used for use in cutting and boring applications, such as for horizontal directional drilling applications. This may be used for placement or cables, wires, conduits or other situations where a directed bore and/or drill hole is desired. The sonar housing 22 will typically house a sonar transponder or other sonar emitter that can indicate location of the drill string assembly 10, to facilitate guidance of the drilling by an operator.

From the foregoing description and for other embodiments a few additional observations and/or potential useful features in various embodiments are detailed below.

The features may be particularly beneficial in a directional drilling (HDD) component assembly such as provided by drill string assembly 10. This may include at least a first drill string component and a second adjacent drill string component secured to the first drill string component, which are selected from at least two of the following: the starter rod 18, the starter rod collar 20, the sonar housing 22, optionally the housing or bit adapter 24, and the removable boring bit 26. A step provided by step region 16 is defined between the first drill string component and the second adjacent drill string component. For example as shown in the Figures a step is provided by step region formed by the collar 20 and the starter rod 18, but it may be at other step regions similarly. As discussed above hard facing applied to a region of at least one of the first drill string components and the second adjacent drill string component, the region being proximate the step.

Preferably, the hard facing (e.g. hard facing regions 12, 14) is applied within 0 to 30 centimeters of the step and more preferably within 0 to 15 centimeters of the step.

As shown in the figures, the step may be formed by a radially extending surface (for example, the reverse thrust face 40).

Further, this radially extending surface may extend radially outward away from a first annular surface (for example, the outer diameter 42) of the first drill string component toward a second annular surface (for example, the outer circumferential surface 44) of the second adjacent drill string component.

The hard facing may be applied along at least a portion of at least one, more preferably two and most preferably all three of the radially extending surfaces, the first annular surface and the second annular surface as show.

Further, it is advantageous if the hard facing is selective as shown. In particular, substantial benefit is obtained by very limited application to the exposed external surface as shown in the drawings. For example, the hard facing may be applied to less than 50% of an exposed external surface area of the first drill string component and the second adjacent drill string component, and even more preferably less than 20% of the exposed external surface area of the assembly (as shown in the drawings, it may even be less than 10% of the surface area).

Typically, the first drill string component and the second adjacent drill string component comprise a base material comprising an iron or steel material. Further, the hard facing (hard facing regions 12, 14) may comprise a laser clad bead (e.g. one or more applied beads) applied to the iron or steel material, and preferably the laser clad bead provides a height extending from a surface of the steel material substrate of between 0.01 and 0.25 inch.

As shown, the second adjacent drill string component comprises a collar slidable over the first drill string component, with the hard facing being applied to a reverse thrust face of the collar and an outer circumference of the collar, and applied along the first drill string component adjacent the reverse thrust face. However, this is equally applicable to steps between other drill string components.

The component(s) being hard faced may reside in a location of radially stepped geometry created by the coupling members, or by one individual member either through additive or subtractive manufacturing.

The component(s) can be used in conjunction with a drilling fluid, primarily water mixed with bentonite, whose intended purpose is, but not limited to, aid in the evacuation of the drill cuttings.

Hard facing preferably via laser deposition may be placed cylindrically on the shaft of the component proximally up string of the stepped geometry.

Hard facing via laser deposition may be placed on the reverse thrust face of the stepped geometry.

The hard facing may be comprised of an amorphous alloy, which upon solidification creates boron carbides. This method of hard facing yields a very evenly distributed deposition that possesses hardness in excess of 50 HRC.

The base material for any and/or all of the drill string components may comprise a softer material than the hard facing, most typically steel material.

The hard face coating may be integrally bonded to the boring component body over the steel base material thereof.

Figure 9:
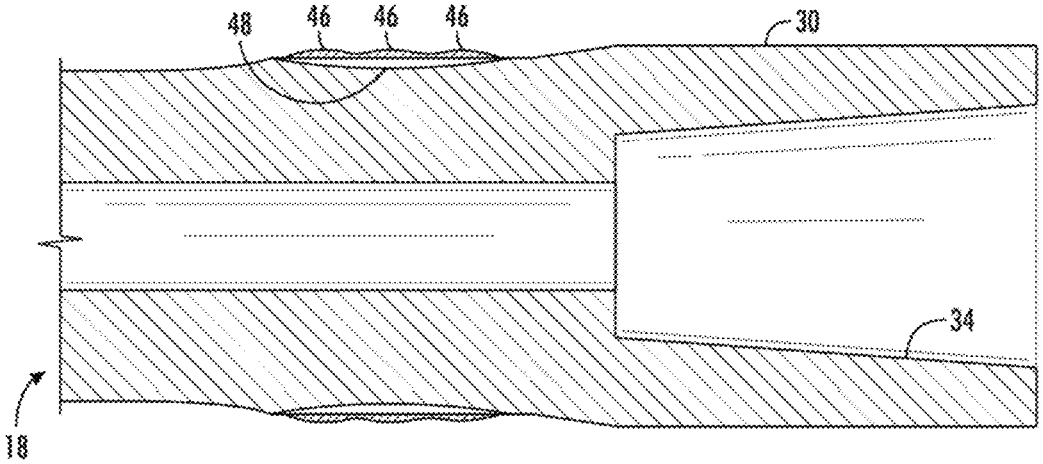
FIG. 9 is an exaggerated cross section schematic of the starter rod shown in FIGS. 7 and 8, but additionally schematically showing the minimal heat affected zone (HAZ). The HAZ is shown below the hard face coating for scale.
Figure 10:
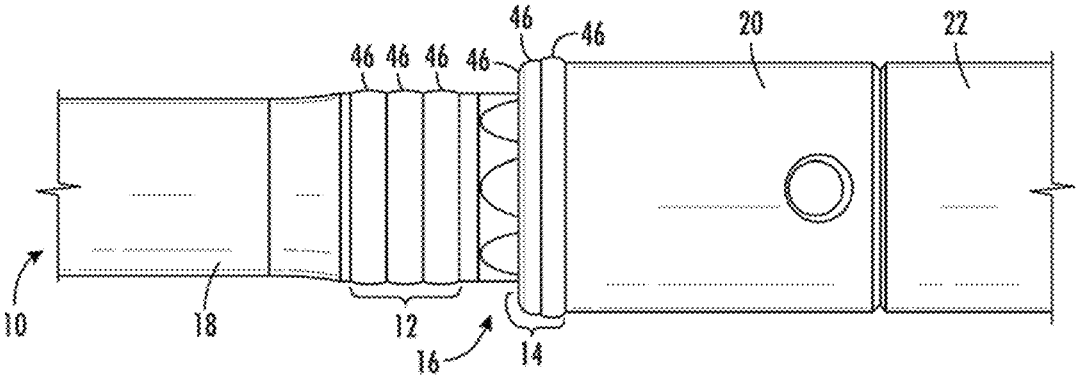
FIG. 10 is a side schematic of the starter rod and coupling collar of that shown in FIGS. 7-9 (but not a cross-section) and additionally with sonar housing complete with hard face coating (e.g. laser clad beads) applied in the appropriate region of stepped geometry.

As schematically indicated in FIGS. 7 & 9, the hard faced layer is preferably applied to both the radial shaft area directly up string of the stepped geometry as well as the reverse thrust face of the stepped geometry. Both regions may have the same average coating thickness.

Figure 8:
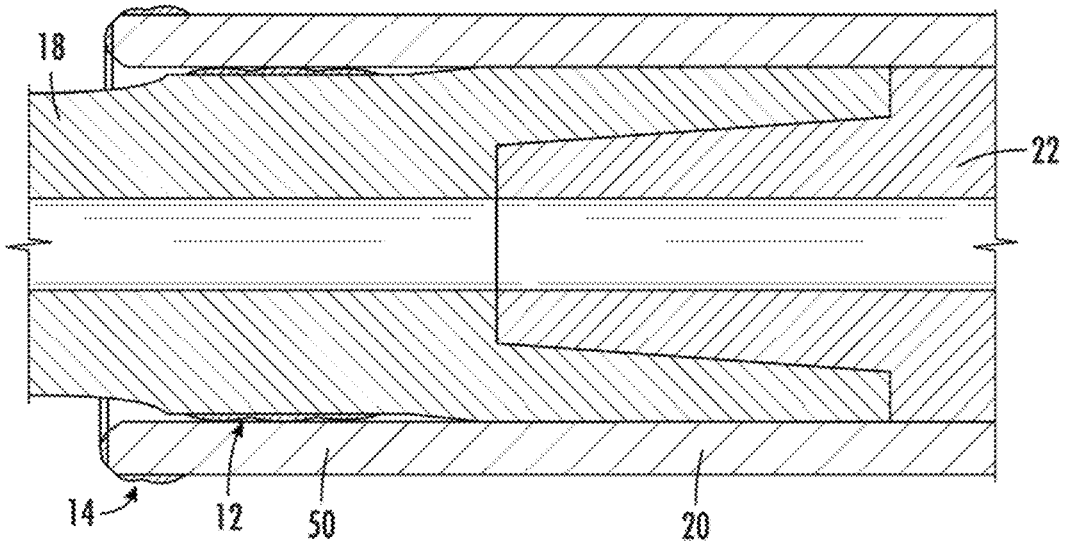
FIG. 8 is an exaggerated schematic cross section axially through a single layer of cladded surface of the starter rod and coupling collar that was shown in FIG. 7 during assembly with the collar installed over the cladding on cladded surface of the starter rod, such that it can be seen that the hard face coating on the starter rod does not exceed the inner diameter of the coupling collar.

The hard face coating may be thin enough to allow any mechanical members to continue operating as original intent. Where this is most desirable is in areas of overlap, and in particular for example where the collar has an annular flange region 50 that overlaps cladding upon the starter rod during the assembly process as shown in FIG. 8.

The hard face coating may be deposited in such a way to create veins or channels to aid in the fluid evacuation, and may be spirally (e.g. helically) wound about a surface, but in other embodiments, annularly, being one or more annular rings of cladding (e.g. the Figures show 3 rings of cladding for each hard face coating although fewer or more rings and/or side-by-side depositions may be applied).

To provide additional reference, a typical boring bit geometry was demonstrated in the Figures by the drill string assembly 10 (with hard facing at a joint between sonar and starter rod). However, other assemblies with more or less components are intended to be covered and other locations along the drill string may be hard faced. The drill string may comprise the sonar housing, starter rod collar, and starter rod, as well as a removable boring bit. The collar embodies a reverse thrust face geometry that may be hard faced, while the starter rod contains the cylindrical shaft geometry that may be hard faced. This is just one portion of the drill string that can encounter recirculation zones and cavitation, and other regions may also be hard faced.

Preferably, the hard face coating extends the entire length of the re-circulation zone, and completely around the perimeter of the component such as shown in the embodiments of FIGS. 7-10. Coating coverage can be reduced both axially in length, and rotationally around the component, but the most effective coating will be the preferred method.

Figure 11:
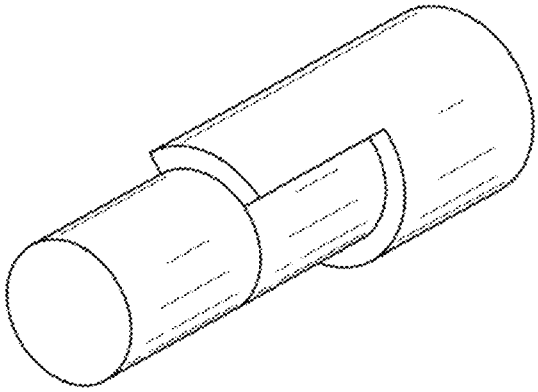
FIG. 11 is a generic drawing of another stepped geometry of one or more drill string components to which this inventive method may be applied with the hard facing such as laser clad beads being applied proximate the stepped surfaces.

However, in some embodiments, selective application that does not extend completely around the perimeter may be applied. For example, some benefit is realized even in less than complete perimeters, as in the embodiment of FIGS. 7-10; but may also be advantageous in other configurations with irregular steps such as in FIG. 11 that also provide a diametrically reduced stepped geometry.

Also, the hard face coating preferably covers the entire reverse thrust face of stepped geometry. This surface also sees re-circulation wear attributes.

Preferably the hard face coating is applied proximate the region of the diametrically reduced stepped geometry, and that may be within 10 times a radial thickness of the step, and more preferably closer within 5 times radial thickness of the step. Such hard facing may be within 0 to 6 inches, more preferably within 0 to 3 inches of the step.

However, hard facing alternatively or additionally may be applied to other regions on the drill string components, preferably with laser cladding.

Laser cladding beads may be generated thinner and/or with not the same heat affected zone (HAZ) as per weld face hard facing. As a result, a significant advantage can be achieved with laser cladding on drill string components that have thickness considerations relative to HAZ and/or hard facing thicknesses.

For example, as shown in FIG. 7, the laser clad bead provides a height (either axial or radial depending upon applied bead) extending from a surface of the steel material substrate of between 0.01 and 0.5 inch, more preferably between 0.01 and 0.25 inch.

Also, a Heat Affected Zone (HAZ) formed under the laser clad bead does not extend beyond 0.125 inch of the steel material substrate after coating, more preferably less than 0.08 inch.

Generally, while the description above is an effective and efficient embodiment of the invention, it should be understood that the invention is not limited to just the above configuration.

In a Horizontal Directional Drilling (HDD) operation utilizing a liquid slurry the drill string components may be selectively hardened to extend life and control wear characteristics. A drill string may be composed of a bit, sonar housing, and starter rod where said components are attached together via locking collars, threads and splines used in conjunction with a liquid slurry wherein the slurry is directed along the drill string.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents cited herein are hereby incorporated by reference to the same extent as if each reference were individually and specifically indicated to be incorporated by reference and were set forth in its entirety herein.

What is claimed is:

1. A horizontal directional drilling (HDD) component for use in a drill string comprising two or more mechanically fastened members that provide a diametrically reduced stepped geometry along a direction of drilling, the horizontal directional drilling (HDD) component comprising:

a drill string component including a selective hard facing arranged to reduce accelerated wear proximate a region of the diametrically reduced stepped geometry that is at a joint location which creates a step when the drill string component is arranged in overlapping relation with another of the mechanically fastened members such that the drill string component has a predetermined recirculation zone region with the selective hard facing applied along the predetermined recirculation zone region, the selective hard facing comprising a first discrete region applied on only one drill string component so as not to join to any other drill strip component through the selective hard facing.

2. The horizontal directional drilling (HDD) component of claim 1 wherein the drill string component is a starter rod.

3. The horizontal directional drilling (HDD) component of claim 2 wherein the starter rod utilizes a polygonal spline on the outer surface and internal thread region on the inner diameter to affectively lock it to the adjacent component.

4. The horizontal directional drilling (HDD) component of claim 2 wherein the starter rod has an outer diameter between 1 and 6 inches.

5. The horizontal directional drilling (HDD) component of claim 1 wherein the drill string component is a coupling collar.

6. The horizontal directional drilling (HDD) component of claim 5 wherein the collar utilizes a polygonal inner spline to join two drill string components together.

7. The horizontal directional drilling (HDD) component of claim 5 wherein the collar has an outer diameter between 1 and 8 inches.

8. The horizontal directional drilling (HDD) component of claim 1 wherein the drill string component is a sonar housing.

9. The horizontal directional drilling (HDD) component of claim 8 wherein the sonar housing utilizes a polygonal outer spline on the outer surface and external thread region on a boss diametrically smaller than the polygonal spline to affectively lock it to the adjacent component.

10. The horizontal directional drilling (HDD) component of claim 1 wherein the drill string component is a drill bit adapter.

11. The horizontal directional drilling (HDD) component of claim 1 wherein the drill string component is a drill bit.

12. The horizontal directional drilling (HDD) component of claim 1 wherein the drill string component is a drill pipe.

13. The horizontal directional drilling (HDD) component of claim 1 wherein the drill string component is a drill reamer.

14. The horizontal directional drilling (HDD) component of claim 1 wherein the diametrically reduced stepped geometry is a minimum of 5% and a maximum of 99% relative to the components being joined, or the component used to join them together.

15. A method of creating the horizontal directional drilling (HDD) component of claim 1 wherein the method for forming the selective hard facing comprises:

melting the base material with a laser to form a melt pool;

depositing a stream of particles of the clad material into the melt pool; and solidifying the melt pool to affix the particles of the hard material.

16. The horizontal directional drilling (HDD) component of claim 1 wherein the hard facing comprises a laser clad hard face coating.

17. The horizontal directional drilling (HDD) component of claim 16 wherein the hard face coating has a coating hardness greater than 50 HRC.

18. The horizontal directional drilling (HDD) component of claim 16 wherein the hard face coating comprises a matrix primarily of nickel and tungsten carbide.

19. The horizontal directional drilling (HDD) component of claim 1 wherein the hard facing comprises a Plasma Transferred Arc (PTA) hard face coating.

20. The horizontal directional drilling (HDD) component of claim 19 wherein the hard face coating has a hardness greater than 50 HRC.

21. The horizontal directional drilling (HDD) component of claim 1 wherein the hard facing comprises a mechanically bonded coating.

22. The horizontal directional drilling (HDD) component of claim 21 wherein the hard face coating has a hardness greater than 50 HRC.

23. The horizontal directional drilling (HDD) component of claim 1 wherein the hard facing is placed on a reverse thrust face of the diametrically reduced stepped geometry.

24. The horizontal directional drilling (HDD) component of claim 1 wherein the hard facing is placed on an outer diameter immediately up-string from the diametrically reduced stepped geometry.

25. The horizontal directional drilling (HDD) component of claim 1 wherein a Heat Affected Zone (HAZ) formed at the selective hard facing does not extend beyond 0.08 inch of a base material surface of the drill string component after coating.

26. A directional drilling (HDD) component assembly comprising the horizontal directional drilling (HDD) component of claim 1, and further comprising an adjacent drill string component secured to said drill string component to provide the diametrically reduced stepped geometry.

27. The horizontal directional drilling (HDD) component assembly of claim 26, wherein the adjacent drill string component includes a flange region that is sized to overlap the selective hard facing of said drill string component.

28. The horizontal directional drilling (HDD) component assembly of claim 26, wherein the adjacent drill string component includes a selective hard face including a second discrete region spaced from the first discrete region of the said drill string component and proximate the region of the diametrically reduced stepped geometry.

29. A horizontal directional drilling (HDD) component for use in a drill string comprising two or more mechanically fastened members that provide a diametrically reduced stepped geometry along a direction of drilling, the horizontal directional drilling (HDD) component comprising: a drill string component including a selective hard facing arranged to reduce accelerated wear proximate a region of the diametrically reduced stepped geometry, wherein the selective hard facing is applied along at least the smaller circumferential region for the diametrically reduced stepped geometry to a minimum axially extending length of 5% and a maximum axially extending of 50% of an outer circumference of the components being joined.

30. A horizontal directional drilling (HDD) component for use in a drill string having a plurality of assembled members that include a step in an outer profile thereof, comprising:

a drill string component including a selective hard facing comprising a laser clad bead deposited upon a steel material substrate of the drill string component, wherein the drill string component is other than a drill bit and comprises: an HDD starter rod, an HDD coupling collar, an HDD sonar housing, an HDD drill bit adapter, an HDD drill pipe, or an HDD drill reamer, or any combination thereof, wherein the selective hard facing comprises a first discrete region that is arranged to be proximate the step in an outer profile of the drill string, wherein the drill string component has a predetermined recirculation zone region with the selective hard facing applied along the predetermined recirculation zone region, wherein the predetermined recirculation zone region is created at a joint location when the drill string component is arranged in overlapping relation with another of the assembled members creating the step in the outer profile, the first discrete region applied on only one drill string component allowing separability from an adjacent drill string component at the selective hard facing.

31. The horizontal directional drilling (HDD) component of claim 30, wherein a Heat Affected Zone (HAZ) formed under the laser clad bead does not extend beyond 0.08 inch of the steel material substrate after coating.

32. The horizontal directional drilling (HDD) component of claim 30, wherein the laser clad bead provides a height extending from a surface of the steel material substrate of between 0.01 and 0.25 inch.

33. A directional drilling (HDD) component assembly comprising:

a first drill string component;

a second adjacent drill string component secured to the first drill string component;

a step defined along an outer periphery and at a joint location between the first drill string component and the second adjacent drill string component, which provides a recirculation zone region between the first drill string component and the second adjacent drill string component; and a hard facing proximate the step and along the recirculation zone region, the hard facing being: (a) applied only to the first drill string component or (b) applied only to the second adjacent drill string component or (c) applied to both of the first drill string component and the second adjacent drill string component as separate disjoined regions of the hard facing.

34. The directional drilling (HDD) component assembly of claim 33, wherein the hard facing is applied within 0 to 30 centimeters of the step.

35. The directional drilling (HDD) component assembly of claim 34, wherein the step is formed by a radially extending surface extending radially outward away from a first annular surface of the first drill string component toward a second annular surface of the second adjacent drill string component, wherein the hard facing is applied along at least a portion of: the radially extending surface, the first annular surface or the second annular surface, or any combination thereof.

36. The directional drilling (HDD) component assembly of claim 35 wherein the hard facing is applied along at least portions of at least two of the radially extending surfaces, the first annular surface and the second annular surface.

37. The directional drilling (HDD) component assembly of claim 35 wherein the hard facing is applied along at least portions of all three of the radially extending surfaces, the first annular surface and the second annular surface.

38. The directional drilling (HDD) component assembly of claim 33, wherein the hard facing is applied to less than 50% of an exposed external surface area of the first drill string component and the second adjacent drill string component.

39. The horizontal directional drilling (HDD) component of claim 33, wherein the first drill string component and the second adjacent drill string component comprise a base material comprising an iron or steel material, wherein the hard facing comprises a laser clad bead applied to the iron or steel material, and wherein the laser clad bead provides a height extending from a surface of the steel material substrate of between 0.01 and 0.25 inch.

40. The horizontal directional drilling (HDD) component of claim 33, wherein the second adjacent drill string component comprises a collar slidable over the first drill string component, the hard facing being applied to a reverse thrust face of the collar and an outer circumference of the collar, and applied along the first drill string component adjacent the reverse thrust face.

* * * * *